US009950847B2

(12) United States Patent
Hayton et al.

(10) Patent No.: US 9,950,847 B2
(45) Date of Patent: Apr. 24, 2018

(54) SECONDARY PACKAGING, AND METHOD FOR PROVIDING IT

(71) Applicant: TETRA LAVAL HOLDINGS & FINANCE S.A., Pully (CH)

(72) Inventors: Paul Hayton, Bristol (GB); Fredrik Orremo, Malmö (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 15/103,746

(22) PCT Filed: Dec. 8, 2014

(86) PCT No.: PCT/EP2014/076857

§ 371 (c)(1),
(2) Date: Jun. 10, 2016

(87) PCT Pub. No.: WO2015/086515

PCT Pub. Date: Jun. 18, 2015

(65) Prior Publication Data

US 2016/0311594 A1 Oct. 27, 2016

(30) Foreign Application Priority Data

Dec. 13, 2013 (SE) ..... 1351495

(51) Int. Cl.
*B65D 1/34* (2006.01)
*B65D 6/04* (2006.01)
(Continued)

(52) U.S. Cl.
CPC ..... *B65D 71/70* (2013.01); *B65D 5/5059* (2013.01); *B65D 71/10* (2013.01); *B65D 71/42* (2013.01);
(Continued)

(58) Field of Classification Search
CPC ..... B65D 71/70; B65D 5/5059; B65D 71/10; B65D 71/42; B65D 2301/10; B65D 2571/00993
(Continued)

(56) References Cited

U.S. PATENT DOCUMENTS 2,415,218 A 2/1947 Rhodes et al.
3,219,181 A * 11/1965 Dahm ..... B65D 5/5206 206/45.21
(Continued)

FOREIGN PATENT DOCUMENTS

CN 1781821 A 6/2006
EP 1 657 166 A2 5/2006
(Continued)

OTHER PUBLICATIONS

International Search Report (PCT/ISA/210) dated May 13, 2015, by the European Patent Office as the International Searching Authority for International Application No. PCT/EP2014/076857.
(Continued)

*Primary Examiner* — J. Gregory Pickett
*Assistant Examiner* — Rafael Ortiz
(74) *Attorney, Agent, or Firm* — Buchanan Ingersoll & Rooney PC

(57) ABSTRACT

A secondary packaging comprises a tray and an insert. The tray is configured to localize a lower end of primary packages and the insert is configured to localize an upper end of the primary packages. The insert is formed from the material of the tray.

14 Claims, 2 Drawing Sheets

(51) Int. Cl.
*B65D 71/70* (2006.01)
*B65D 71/10* (2006.01)
*B65D 5/50* (2006.01)
*B65D 71/42* (2006.01)

(52) U.S. Cl.
CPC ..... *B65D 2301/10* (2013.01); *B65D 2571/00993* (2013.01)

(58) Field of Classification Search
USPC ..... 206/432, 562, 139, 736, 756, 45.26; 229/122.2, 161
See application file for complete search history.

(56) References Cited

U.S. PATENT DOCUMENTS 3,929,274 A * 12/1975 Akkerman ..... B65D 5/46192 206/139
4,036,362 A 7/1977 Ullman
6,158,589 A 12/2000 Smith et al.
7,360,647 B2 * 4/2008 Ogg ..... B65D 5/28 206/139
7,882,956 B2 2/2011 McDonald et al.
2005/0150783 A1 7/2005 Ogg

FOREIGN PATENT DOCUMENTS

EP 1 787 915 A1 5/2007
EP 1787915 A1 * 5/2007 ..... B65D 5/18

OTHER PUBLICATIONS

Written Opinion (PCT/ISA/237) dated May 13, 2015, by the European Patent Office as the International Searching Authority for International Application No. PCT/EP2014/076857.
Office Action dated Jun. 16, 2014, by the Swedish Patent Office in corresponding Patent Application No. 1351495-5.

* cited by examiner

SECONDARY PACKAGING, AND METHOD FOR PROVIDING IT

TECHNICAL FIELD

The present invention relates to secondary packaging, i.e. packaging used in order to contain packaging containers during transport or storage.

TECHNICAL BACKGROUND

When a product is packaged in packaging containers for further delivery within a value chain it is common practice to arrange the packaging containers in some sort of secondary packaging. This secondary packaging may consist of a cardboard box, a tray, a dispenser box or simply a plastic bag.

The present disclosure relates to secondary packaging particularly well suited to contain packaging containers in the form of bottles or bottle like packaging containers. The bottles may be regular plastic bottles, glass bottles or carton bottles, referred to as "primary packages". "Carton bottles" may be used to describe a packaging container having the overall appearance of a bottle, yet being made fully of cardboard, or a fusion between a cardboard sleeve and a plastic top comprising an opening device. Two examples of the latter would be Tetra Top™ and Tetra Evero Aseptic™ by the present applicant.

One type of secondary packaging uses a tray in which a base end of the primary packages is arranged, and an insert localizing a top end of the packages.

The present disclosure relates to an improved secondary packaging of using a tray and insert

SUMMARY

According to a first aspect the present invention provides a secondary packaging comprising a tray for localizing a base end of primary packages and an insert for localizing a top end of primary packages, characterized in that the insert is punched.

In one or more embodiments the insert further comprises recesses for improved localization of the top end of the primary packages, preferably one recess for each primary package.

In one or several embodiments the insert further comprises tabs for localisation of the insert in relation to a top end of the primary packages. Each tab has one end pivotally attached to the insert and a free end.

In one or more embodiment the tab is formed in one piece with the insert.

In one or more related embodiments the tabs are configured to be arranged in a position normal to a main surface of the insert. In this way, if the tabs are bent towards the top of the primary packages the extension of the tabs may be used to align the insert in relation to the very top end of the packages. The bent tabs may also increase the contact area between the insert and the primary packages thus improving the distribution of any load.

In any embodiment the secondary packaging may be complimented with a wrap, such as a shrink wrap, ensuring the integrity of the secondary packaging. The wrap will also align the free end of the tab with the top end of a primary package.

According to another aspect of the present disclosure relates to an insert according to the above or below description is disclosed. The insert may be used in combination with the tray as disclosed or in combination with any other tray, or even without a tray.

According to still another aspect it is disclosed a method for manufacturing a secondary packaging according to any previous or following description. In particular such a method may include the step of punching an insert from a tray. The method may also comprise punching the tray from a larger piece of material, as well as folding the sides of the tray to make it more adapted to localize and protect the base end of primary packages arranged therein.

A secondary packaging comprising a tray and an insert, wherein the tray is configured to localize a lower end of primary packages and the insert is configured to localize an upper end of the primary packages, wherein the insert is formed from cutout material of the tray.

The insert may comprise recesses for localizing an upper end of the primary packages.

The insert may comprise tabs formed in one piece with the insert, wherein the tabs has a free end and are pivotally associated with the insert.

The tabs may be arranged in recesses for localizing an upper end of the primary packages.

The tabs may be positioned to, in a use position, engage the primary packages.

The tabs may be positioned to engage a neck or an opening device of the primary packages.

An insert for use in a secondary packaging may comprise recesses for localizing an upper end of primary packages and pivotable tabs for localizing the insert in relation to the upper end of the primary packages.

According to another aspect the disclosure relates to a method for manufacturing a secondary packaging having a tray for localizing a lower end of primary packages and an insert for localizing an upper end of primary packages, said method comprising: providing a piece of raw material, cutting the insert from the raw material, thus forming a cutout in the raw material, forming the tray from an area of the raw material comprising the cutout.

According to one or more embodiments the insert may be maintained positioned in the cutout of the tray in a transportation step, for later separation.

In one or more embodiments the insert may be separated from the tray, either before or after having transported the secondary packaging to a location in which it will be used for its ultimate purpose.

DETAILED DESCRIPTION

Figure 1:
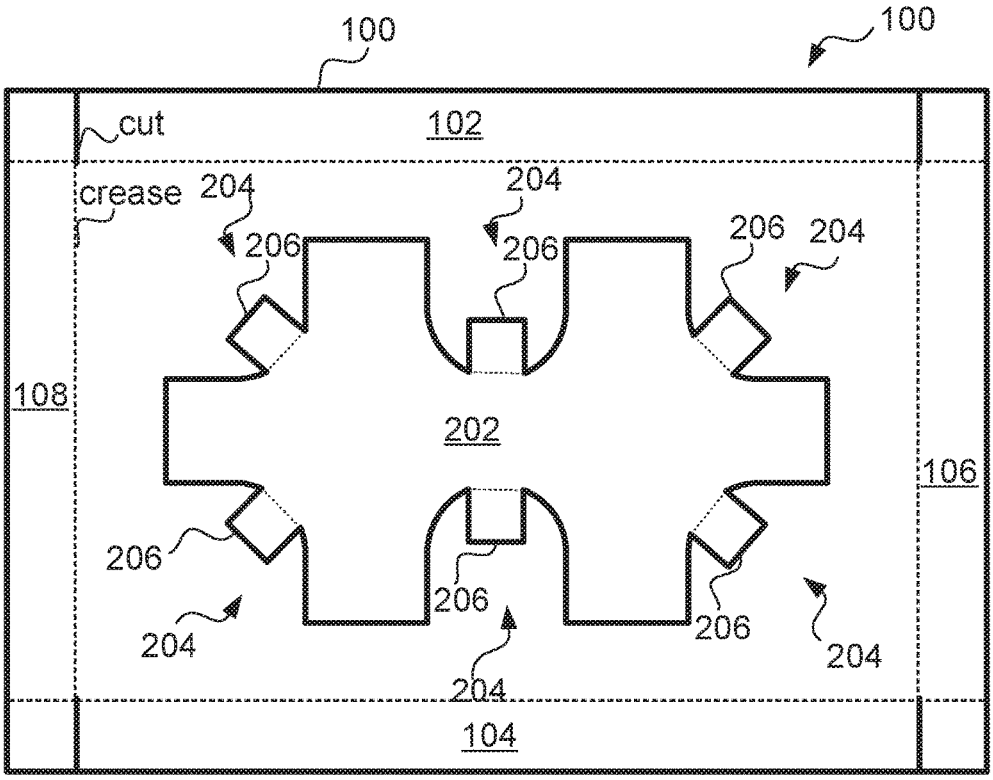
FIGS. 1 and 2 are plan views illustrating a secondary packaging according to a first embodiment.

FIG. 1 illustrates a first embodiment of the present invention, in a schematic, yet clear manner. A piece of raw material 100, such as a rectangle made from cardboard, is used as a starting point during the manufacture of the secondary packaging of the present embodiment. An insert 200 is punched out from the raw material 100, effectively dividing it into the insert 200 and a tray, also designated with the reference numeral 100. To punch the shape with a knife or stamp is one option available to the skilled person, yet there are numerous other ways to cut out shapes in a material such as cardboard. The present invention should therefore not be limited to a single cutting method, and the present disclosure does not relate to novel methods of cutting cardboard but to a particular secondary packaging.

In the present embodiment the tray 100 is provided with sub panels, 102, 104, 106, 108, which may be separated from a main body of the tray 100 by means of creasing lines or "weakening lines" indicated by dotted lines in FIG. 1. The wakening lines may be accomplished by pressing or deforming the material locally in a manner commonly used in manufacture of cardboard boxes of various types. The sub panels 106 and 108 are also provided with creasing lines and cuts (the latter indicated by full lines) separating them from the neighbouring panels 102, 104. This arrangement makes it easy to fold the sub panels to a standing position, normal to the plane of the main body, thus forming sidewalls of the tray 100. The cuts and creases may instead be arranged in the panels 102, 104 and in other embodiments it is enough with creasing lines to form the sidewalls. In still other embodiments the sidewalls may be left out, leaving the main body of the tray only. The sidewalls may be secured in a raised state by means of an adhesive such as a hotmelt, yet they may also be forced and maintained in a raised state by a wrap arranged around the secondary packaging once the primary packages are arranged therein. One example of such wrap may be a shrink wrap or other plastic commonly used in relation to secondary packaging.

Turning to the insert 200, it may be described as having a rectangular shape in a central body 202 and being provided with recesses 204 or cutouts. A purpose of the recesses 204 is to localize or position the neck of a primary package, such as the neck of a bottle. In one or more of the recesses 204, preferably though not necessarily all, a tab 206 is arranged. The tab 206 is readily formed during the manufacturing process. Each tab 206 has a free end and a weakening line may be arranged at the end which is connected to the central body 202. For the sake of simplicity it is preferred that the tabs 206 are formed in the same piece with the central body 202. The weakening line, also indicated by a dotted line, helps the tab 206 to pivot, and though it is not absolutely crucial it does add to the functionality of the tab 206, and as such it ensures a reliable function. A length of the tab 206 is defined as the extension from the free end to the pivot axis (the weakening line if there is one). The length of the tabs 206, as will be explained in relation to FIGS. 3 and 4, will have a beneficial effect. The insert as described above and below may be used without the tray 100, since it does have functional advantages beyond the beneficial effect of saving raw material. The particular location of the tabs as illustrated in the drawings also has the effect that the tabs are located as close to the centre of the central body as possibly, thus minimizing torsion effects.

Figure 2:
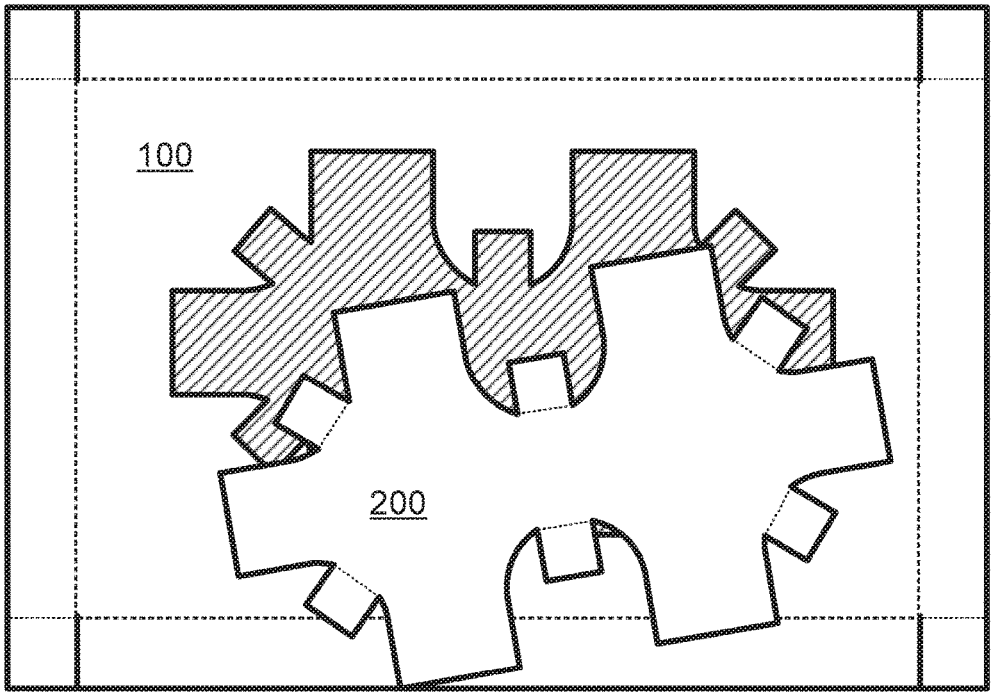

In FIG. 2 it is indicated how the insert 100 is lifted from the tray 200. The secondary package will be used when arranging the primary packages therein, i.e. after filling of the primary packages. The manufacture of the secondary packaging may be performed in close proximity of where it will be used, yet it may also be performed at another site, if that is considered more efficient.

Figure 3:
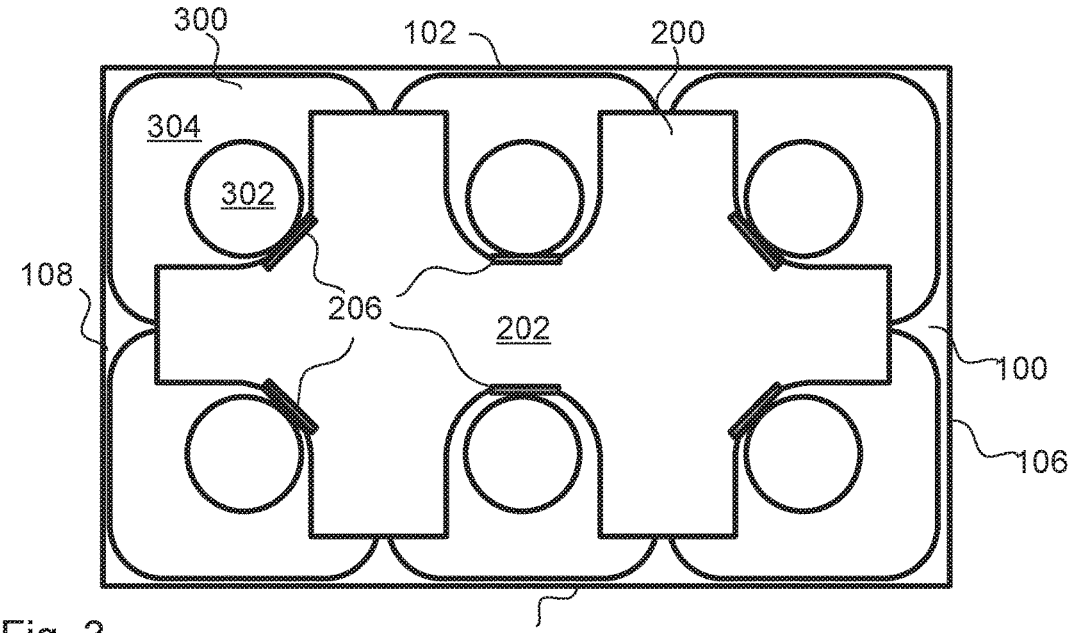
FIG. 3 is a plan view showing a number of primary packages arranged in a secondary packaging according to the first embodiment.

FIG. 3 is a plan view of six primary packages 300 arranged in a secondary packaging comprising a tray 100 and an insert 200. The primary packages comprise a shoulder portion 302 and an opening device 304. After having arranged the primary packages 300 in the tray 100, or at least having arranged them in a similar configuration, the insert 200 is pressed down between the primary packages 300 by means of a relative motion. When doing this the tabs 206 will fold upwards. When doing so they may act as a positioning means for the insert in relation to the top of the primary packages 300. The shape of the primary packages 300 may prevent the insert 200 from sliding downwards, and in combination with the tabs 206 the insert 200 will be localized with great precision such that the insert 200 may fulfil its ultimate purpose of localizing the primary packages such as to protect them from damage during transportation and storage. FIG. 3 contains more reference numerals than what has been referred to here, yet for those reference numerals reference is made to FIGS. 1 and 2.

Figure 4:
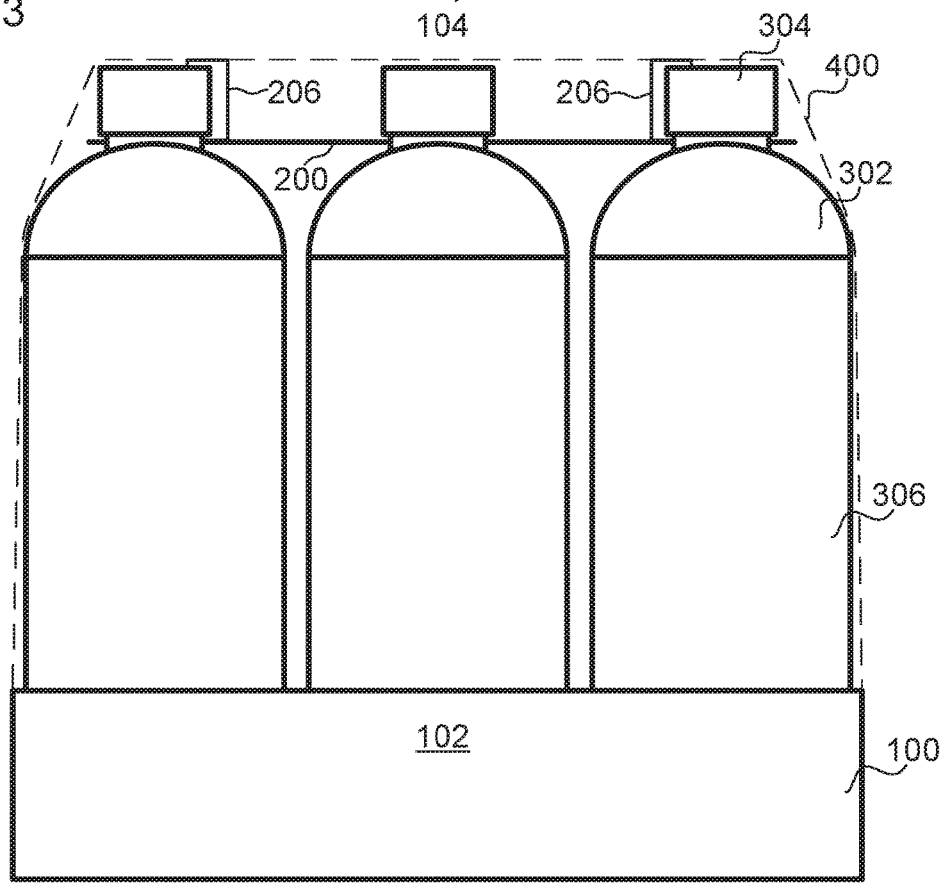
FIG. 4 is a side view of the arrangement of FIG. 3.

FIG. 4 is a sideview of the arrangement of FIG. 3. The primary packages 300 are shown as carton bottles, having an opening device 304, a shoulder portion 302 made from plastic and a body portion 306 formed from a packaging laminate based on a paper core with plastic layers laminated thereto. This is merely an example, and it is apparent that present secondary packaging may be used for other containers such as bottles made from plastic, PET, glass, etc. The tray 100 will in this example localize the primary packages both by restricting their motion in a lateral direction and of course by aligning the bottom of the primary packages since they are all resting on the tray. In other embodiment only one of the localization effects may be utilized, and in still other embodiments where the tray is omitted the localization effect may be accomplished by other means, for example by a shrink wrap.

In the view of FIG. 4 a wrap, such as a shrink wrap 400 is indicated. This shrink wrap 400 will localise the free end of the tabs 206 and thereby the insert 200 as such. The same effect could be accomplished by arranging a further tray 100 on top of the first one, or by arranging the primary packages 300 in a cardboard box (not shown) with a closed lid, etc. This highlights that for the present secondary packaging the insert 200 does not necessarily have to be used in combination with the tray, although the disclosed way of manufacturing the insert from the tray still is beneficial.

A suitable material for the secondary packaging is cardboard or any similar material, and for the wrap any material commonly used as shrink wrap may be used.

It should be appreciated that the present disclosure has the purpose of explaining a few examples of the present invention in order to enable for the skilled person to practise it within the full scope. The fact that not all possible embodiments and uses have not been disclosed should not be interpreted as limiting for the scope of the present disclosure as defined only by the claims in the form they may have. For example, the disclosed position of the tabs results in a number of effects. This does not remove the fact that one or more tabs arranged at other positions, instead or in combination with the original tabs, may result in part of the same effects. The fact that cardboard is the only material explicitly mentioned does not remove the possibilities of using other materials having suitable properties. "Suitable properties" may in this respect refer to rigidity, stiffness, durability, cost, etc. Furthermore, the drawings only illustrate an example with six primary packages, yet it does not exclude examples having 3, 4, 5, 6, 7, 8, 9 . . . etc primary packages from the scope of the claims.

Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second" etc do not preclude a plurality. Reference signs in the claims are provided merely as a clarifying example and shall not be construed as limiting the scope of the claims in any way.

The invention claimed is:

1. A secondary packaging comprising a tray and an insert, wherein the tray is configured to localize a lower end of primary packages and the insert is configured to localize an upper end of the primary packages, wherein the tray includes a through hole, and the insert is formed from material of the tray cut-out from the tray to form the through hole in the tray the through hole possessing an inner periphery outlining a shape, the insert possessing an outer periphery outlining a shape that is the same as the shape of the inner periphery of the through hole in the tray.

2. The secondary packaging of claim 1, wherein the insert comprises recesses for localizing an upper end of the primary packages.

3. The secondary packaging of claim 1, wherein the insert comprises tabs formed in one piece with the insert, wherein the tabs has a free end and are pivotally associated with the insert.

4. The secondary packaging of claim 3, wherein the tabs are arranged in recesses for localizing an upper end of the primary packages.

5. The secondary packaging of claim 4, wherein the tabs are positioned to, in a use position, engage the primary packages.

6. The secondary packaging of claim 5, wherein the tabs are positioned to, in the use position, engage a neck or an opening device of the primary packages.

7. The secondary packaging of claim 1, being made from cardboard.

8. The secondary packaging of claim 1, wherein the tray includes a central area and sub panels positioned along an outer edge of the central area, each of the sub panels being connected to the central area by crease lines along which the sub panels are foldable to an upstanding position relative to the central panel, a part of the central area including the through hole.

9. The secondary packaging of claim 8, wherein the tray possesses four sides defining a rectangular-shaped tray, and the sub panels include four sub panels each positioned along one of the sides of the rectangular-shaped tray.

10. The secondary packaging of claim 9, wherein the part of the central area of the tray at which is located the through hole is a center part of the central area, the central area of the tray also including a surrounding part surrounding the center part, the surrounding part of the central area of the tray including four corner regions that are each devoid of a through hole and configured to support one of the primary packages.

11. The secondary packaging of claim 1, wherein the insert comprises a plurality of curved corner recesses each configured to receive, in a use position, an upper end of one of the primary packages, the insert also including a tab projecting outwardly away from each of the curved corner recesses and connected to the curved corner recess by a weakening line constituting a pivot axis about which the tab is pivotable when engaged by one of the primary packages.

12. An arrangement comprising:

the secondary packaging of claim 5; and primary packages with which the tabs are engaged.

13. An arrangement comprising:

the secondary packaging of claim 6;

primary packages, each primary package including a neck or an opening device; and the tabs each engaging the neck or opening device of a corresponding primary package.

14. A secondary packaging in combination with plural primary packages that are each filled, the primary packages each including a lower end and an upper end, the secondary package comprising a tray, the lower end of each of the primary packages resting on a main body of the tray, the main body of the tray on which the lower ends of the primary packages are resting including a cut-out portion in which material forming the main body is cut-out so that a through hole exists in the tray, the cut-out portion of the main body constituting an insert that engages the upper ends of the plural primary packages, the lower ends of the primary packages resting on the main body of the tray provided with the through hole, the through hole in the tray possessing an inner periphery outlining a shape, the insert possessing an outer periphery outlining a shape that is the same as the shape of the inner periphery of the through hole in the tray.

* * * * *